United States Patent [19]

Hamill et al.

[11] Patent Number: 4,666,169

[45] Date of Patent: May 19, 1987

[54] SKATE APPARATUS

[75] Inventors: Steve Hamill; A. A. Knight, both of Roswell, N. Mex.

[73] Assignee: Roller Barons, Inc., Roswell, N. Mex.

[21] Appl. No.: 665,704

[22] Filed: Oct. 29, 1984

Related U.S. Application Data

[63] Continuation-in-part of Ser. No. 599,966, Apr. 12, 1984.

[51] Int. Cl.[4] ..... A63C 17/04

[52] U.S. Cl. ..... 280/11.23; 280/11.27; 301/63 PW

[58] Field of Search ..... 280/7.14, 11.12, 11.19, 280/11.2, 11.23, 11.27, 7.13; 301/5.3, 5.7, 124 R, 63 PW

[56] References Cited

U.S. PATENT DOCUMENTS

| | | | |
|---|---|---|---|
| D. 121,370 | 7/1940 | Goetsch | D21/226 |
| D. 206,941 | 2/1967 | Carter | D34/14 |
| D. 236,741 | 9/1975 | Smith | D34/14 C |
| D. 238,386 | 1/1976 | Smith | D34/14 C |
| D. 241,868 | 10/1976 | Smith | D34/14 C |
| D. 264,612 | 5/1982 | Szegi | D21/226 |
| 674,096 | 5/1901 | Pease | 280/11.115 |
| 920,848 | 5/1909 | Eubank, Jr. | 280/11.23 |
| 954,993 | 4/1910 | Peters | 280/11.19 |
| 1,866,134 | 7/1932 | Smith | 280/11.23 |
| 2,240,532 | 5/1941 | Warner | 280/11.23 |
| 2,479,255 | 8/1949 | Pudge | 280/11.23 |
| 2,552,987 | 5/1951 | Loertz, Jr. | 280/11.27 |
| 3,212,786 | 10/1965 | Florjancic et al. | 280/11.12 |
| 3,936,061 | 2/1976 | Wada | 280/11.23 |
| 4,095,846 | 6/1978 | Agins | 301/63 PW |
| 4,217,944 | 8/1980 | Pascal | 30/63 PW |
| 4,447,093 | 5/1984 | Cunard et al. | 301/63 PW |
| 4,531,785 | 7/1985 | Perkins | 301/5.7 |

*Primary Examiner*—John J. Love
*Assistant Examiner*—Richard Camby
*Attorney, Agent, or Firm*—Harness, Dickey & Pierce

[57] ABSTRACT

An improved skate apparatus is disclosed and preferably includes a bifurcated truck assembly that is interlockingly and removably attached to a sole plate, as well as a quick-change wheel and axle apparatus. At least in a two-wheeled version of the roller skate apparatus, the wheels preferably include a generally flat horizontal central portion on the ground-engaging wheel periphery in order to provide greater ease and stability in two-wheeled skating. Various alternate wheel and axle arrangements, adjustable truck assemblies, an optional ice skate attachment, and adjustable and decorative toe stop and bumper embodiments are also disclosed.

7 Claims, 30 Drawing Figures

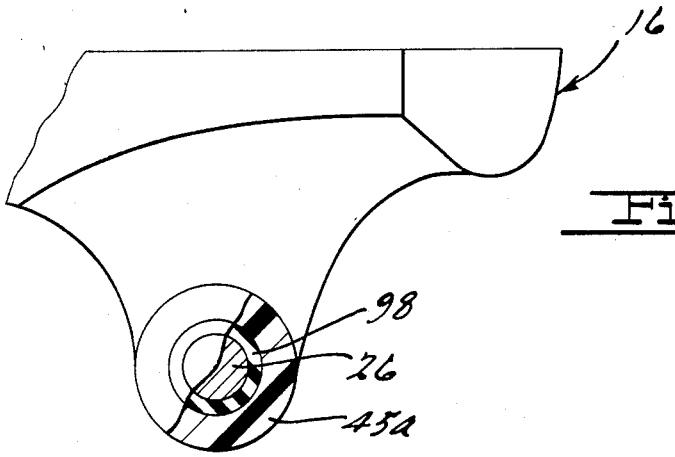
Fig. 25.
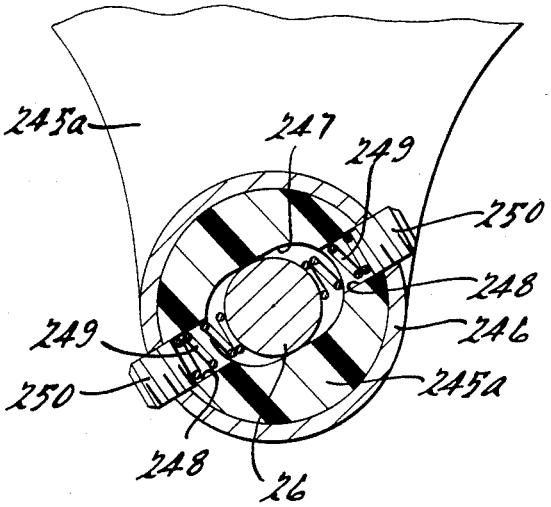
Fig. 26.
Fig. 27.
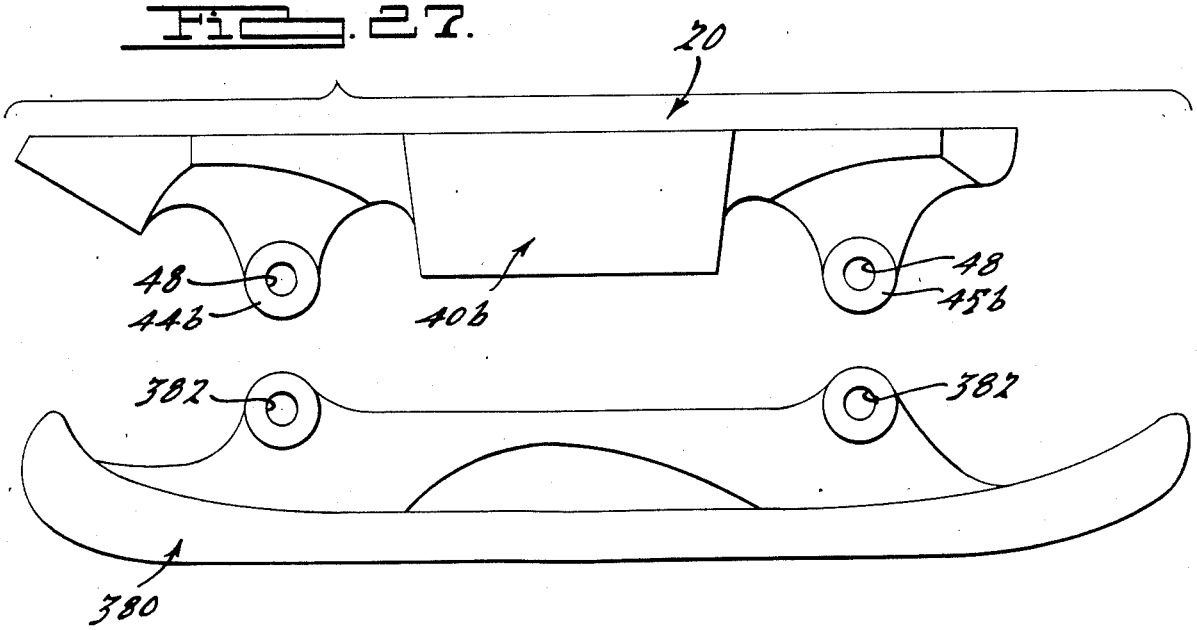

SKATE APPARATUS

This application is a continuation-in-part of the copending application Ser. No. 599,996, filed on Apr. 12, 1984.

BACKGROUND AND SUMMARY OF THE INVENTION

The invention relates generally to roller skates, or roller skate-type devices, and more particularly to support structure assemblies and axle and wheel assemblies therefor.

In light of the recent emphasis on, and greatly increased participation in, physical activities and competitive sports, both recreational and competitive roller skating has emerged as a more significant and sophisticated pastime than it was in the past. As a result, the emphasis upon the production of sophisticated and high quality roller skating equipment has rapidly increased. Furthermore, both two and four-wheeled roller skating has been used to train and condition participants even in non-roller skating athletic programs.

Because of the increased significance and sophistication of roller skating, in both competition and training activities, the materials and designs for wheels and other skate equipment have become quite specialized for various applications and purposes. As a result, some wheels and other equipment have specialized configurations or compositions that are not well-suited for a wide variety of skating applications. Furthermore, especially in the area of two-wheeled roller skating, such specialization and sophistication of wheels and other skate equipment has been found to require a relatively high amount of instruction and training in order to allow participants, especially beginners, to use them. Accordingly, the need has arisen for roller skate equipment that has a high degree of adaptability for various specialized activities, while still maintaining a high degree of sophistication and suitability for such divergent activities. Furthermore, the need has arisen, especially in two-wheeled roller skating, for equipment that allows earlier participation by the beginner, without sacrificing the unique effects and benefits of two-wheeled skating.

According to at least one preferred embodiment of the present invention, a roller skate wheel member has a generally toroidal configuration with a ground-engaging peripheral surface extending circumferentially therearound. In this embodiment of the invention, which is particularly adapted for two-wheeled roller skates, the ground-engaging peripheral surface of each wheel member includes an axially central portion that is generally flat in its diametric cross-sectional configuration and that preferably extends axially in a direction generally parallel to the wheel member's axis of rotation. Preferably, the ground-engaging peripheral surface of each wheel member further includes an arcuate portion disposed axially adjacent one or both sides of the central portion and which curves generally radially inwardly thereform.

Another preferred embodiment of the present invention includes a quick-change wheel mounting and removal apparatus, which can be used on roller skates having any number of wheels and which can be employed separately or in conjunction with the above-discussed wheel configuration. In one form of this embodiment, a truck assembly for supporting a sole plate includes at least two separate truck members with attachment means for removably attaching the truck members to one another in a mutual mating relationship. At least one axle member, which is adapted to removably receive one or more wheels for rotation thereon, includes a portion thereof that is attached to one of the truck members, with the other of the truck members having means thereon for receiving and removably engaging the axle when the truck members are attached to one another. The wheel or wheels can therefore be mounted on, or removed from, the axle or axles when the truck members are detached from one another and are restrained but freely rotatable when the truck members are attached.

In another preferred embodiment of the present invention, the truck assembly of the roller skate is attachable to a sole plate by interlocking means, preferably without the necessity of threaded or other types of fasteners extending between and interconnecting the truck assembly and the sole plate.

In still other embodiments of the invention, the wheels and other skating accessories or devices are adapted to be quickly and conveniently mounted and detached in order to prepare the skate for a wide variety of skating applications and events.

Additional objects, advantages, features and embodiments of the present invention will become apparent from the following description and appended claims, taken in conjunction with the accompanying drawings.

BRIEF DESCRIPTION OF THE DRAWINGS

FIG. 25 is a partial elevational view of another embodiment of the truck member assembly, according to the present invention, having an alternate axle support portion.

FIG. 26 is a view similar to that of FIG. 25, but illustrating still another alternate axle support portion.

FIG. 27 illustrates one of the truck members according to the present invention, along with a detachable optional ice skating runner attachment.

DETAILED DESCRIPTION OF THE PREFERRED EMBODIMENTS

Figure 1:
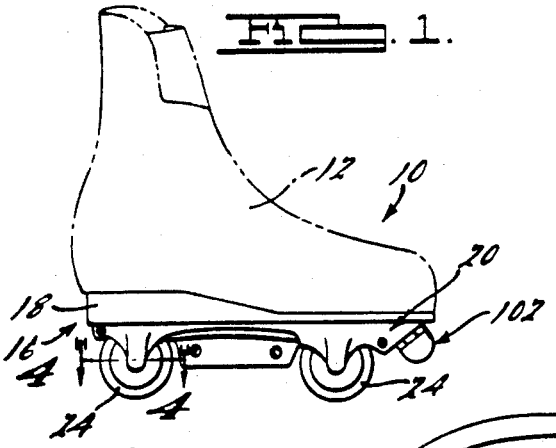
FIG. 1 is a side elevational view of an exemplary roller skate according to the present invention, with its boot, shoe or other footwear item shown in phantom lines.

FIGS. 1 through 30 depict various preferred exemplary embodiments of an improved roller skate apparatus according to the present invention. One skilled in the art will readily recognize from the following discussion that the various embodiments of the invention are equally applicable to roller skate apparatus having virtually any number of wheels, axles, and combinations thereof, as well as being applicable to other skate-like devices.

FIGS. 1 through 4 illustrate a roller skate 10, generally including a boot, shoe, or other similar footwear item 12, supported and suspended upon a support structure assembly 16. The support structure assembly 16 generally includes a sole plate 18 with a truck assembly 20 removably attachable to a lower surface 22 of the sole plate 18 in the exemplary roller skate 10. A pair of wheels 24 include bearing members or assemblies 28 thereon and are removably mounted on the support structure assembly 16 for rotation about their respective axles 26. It should be understood, however, that the exemplary roller skate 10 can include more than two wheels 24 and can have more than one wheel 24 rotatably mounted upon one or more of the axles 26.

Figure 4:
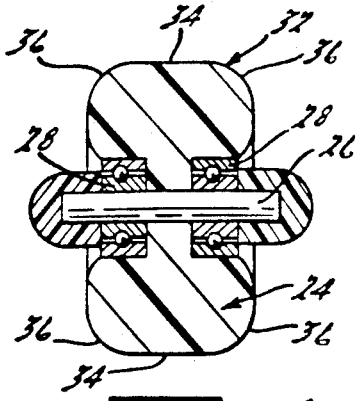
FIG. 4 is a cross-sectional view taken generally along line 4—4 of FIG. 1.

The wheels 24 can be composed of various durable materials known to those skilled in the art, such as polyurethane, polycarbonate, or light-weight metals, and are formed in a generally toroidal configuration, with a ground-engaging peripheral surface 32 extending around their circumference. At least in the illustrated exemplary two-wheeled version of the roller skate 10, the ground-engaging peripheral surface 32 preferably includes a central portion 34 that is generally flat in its diametric cross-section and that extends axially in a direction generally parallel to the axles 26 of the wheel 24, as shown in FIG. 4. The ground-engaging peripheral surface 32 also includes at least one, and preferably two, arcuate portions 36 disposed axially adjacent the central portion 34 and curving generally radially inwardly therefrom. Preferably, the flat central portion 34 has an axial width of at least 50% of the total axial width of the wheel 24.

Figure 21:
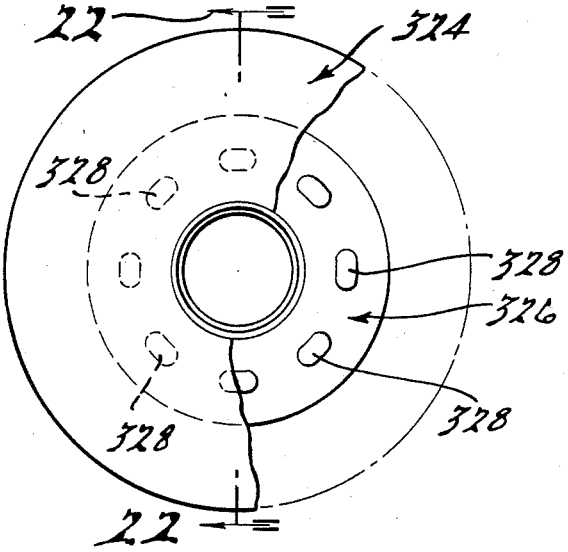
FIG. 21 is a side elevational view of an optional wheel construction, with a portion of the wheel broken away to illustrate an internal reinforcing member.
Figure 22:
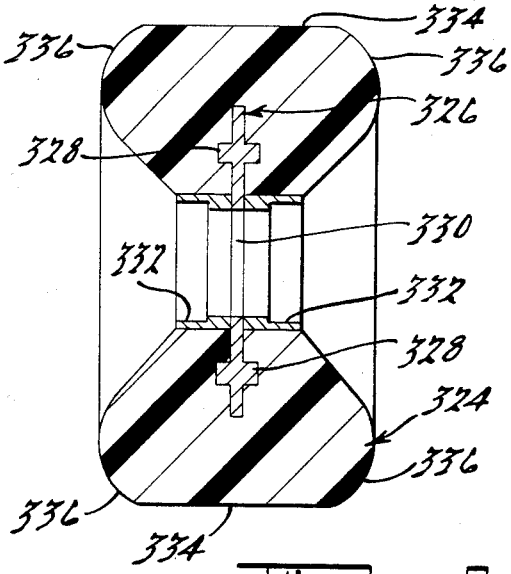
FIG. 22 is a cross-sectional view taken generally along line 22—22 of FIG. 21.

FIGS. 21 and 22 illustrate a wheel 324, which is an optional high-strength, reinforced version of the wheel 24, and which includes arcuate portions 336 and a flat central portion 334 corresponding generally to the above-discussed arcuate portions 36 and flat central portion 34, respectively. The optional wheel 324 includes an internal annular reinforcing disc 326, with circumferentially-spaced protuberances 328 on its axially-facing sides and a central axle-receiving opening 330 therethrough. The wheel 324 also includes generally cylindrical bushings 332 for receiving the axle 26 and any required bearings (not shown). The reinforcing disc 326 and the bushings 332 are integrally molded with the above-mentioned durable material of the wheel 324, and the protuberances 328 help to securely grip the moldable wheel material as it forms. The reinforcing disc 326 adds significant strength to the wheel 324, while still preserving any resiliency and adherence characteristics of the wheel material.

As shown in FIGS. 2, 3, and 5 through 9, one preferred embodiment of the truck assembly 20 includes at least a pair of truck members 40*a* and 40*b* adapted to be removably attached to one another in a generally mutual mating relationship along their respective mutual mating surfaces 42*a* and 42*b*. The preferred truck members 40*a* and 40*b* each include a number of corresponding forward axle support portions 44*a* and 44*b*, and a number of corresponding rearward axle support portions 45*a* and 45*b*, respectively. At least one of the forward axle support portion combinations 44*a* and 44*b* is preferably located so as to be centered under the ball of the skate-wearer's foot, and at least one of the rearward axle support portion combinations 45*a* and 45*b* is preferably centered under the wearer's heel. The exact number of such axle support portions in a given application, however, corresponds to the number of axles 26.

At least one (and preferably both) of the axle support portions 44*a* or 44*b* and 45*a* or 45*b* on the respective truck members 40*a* or 40*b*, respectively, preferably has an end portion of its respective axle 26 press-fit into an aperture 46 or otherwise substantially fixed thereto. The corresponding axle support portion (or portions) on the other of the truck members 40*a* or 40*b* includes a corresponding axle-receiving aperture 48, or other suitable means for removably engaging and supporting the axle, therein. The preferred axle receiving apertures 48 are adapted to slidably receive the opposite ends of the respective axles 26 in a supporting slip-fit relationship therewith such that the wheels 24 may be slidably mounted on, or removed from, their axles 26 when the truck members 40*a* and 40*b* are separated. Accordingly, when the wheels 24 are mounted on their axles 26, and the truck members 40*a* and 40*b* are removably attached to one another, the wheels 24 are restrained on the truck assembly 20 but are freely rotatably about their respective axles 26. It should be noted that the truck members 40*a* and 40*b* can be removably attached to one another by way of a number of threaded fasteners 50, for example, extending through apertures 52*a* and 52*b* in the truck members 40*a* and 40*b*, respectively. One skilled in the art will readily recognize, however, that other suitable attachment means may alternatively be employed for removably attaching the truck members 40*a* and 40*b* to one another.

Referring primarily to FIGS. 2, 3 and 5 through 12, the lower surface 22 of the sole plate 18 preferably includes a forward interlock member 56, an intermediate interlock member 58, and a rearward interlock member 60, all in the form of downwardly-protruding surface discontinuities thereon. Correspondingly, the truck assembly 20 includes openings therein, which form a forward interlock receptacle 62, an intermediate interlock receptacle 64 and a rearward interlock receptacle 66 between the truck members 40*a* and 40*b*. As will be described in detail below, the interlock receptacles 62, 64 and 66 are adapted for interlockingly and removably receiving and engaging the corresponding interlock members 56, 58 and 60, respectively, in order to removably and interlockingly attach the sole plate 18 and the truck assembly 20 to one another. It should be noted that although three sets of interlock member and interlock receptacle combinations are shown for purposes of illustration in the drawings, the sole plate 18 and the truck assembly 20 may include one or more of such combinations.

The interlock members 56, 58 and 60 include undercut edge portions 68, 70 and 72 preferably extending around at least a substantial portion of their respective peripheries. Preferably, at least the forward interlock member 56 and the rearward interlock member 60 are generally plate-shaped in configuration, with their respective undercut edge portions 68 and 72 beveled generally upwardly and inwardly toward the bottom surface 22 of the sole plate 18 such that the lower surface area of the interlock member 56 and 60 is greater than their corresponding horizontal cross-sectional areas.

The forward interlock receptacle 62, the intermediate interlock receptacle 64, and the rearward interlock receptacle 66 are defined at least in part by respective peripheral walls 74, 76 and 78. The peripheral walls 74, 76 and 78 include undercut peripheral wall portions 80, 82 and 84, respectively, on at least part of their peripheries. The undercut peripheral wall portions 80, 82 and 84 of the respective interlock receptacles 62, 64 and 66 are adapted to interlockingly and removably engage the corresponding undercut edge portions 68, 70 and 72 of the corresponding interlock members 56, 58 and 60, respectively.

Preferably, at least the intermediate interlock member 58 is defined by an elongated generally rod-shaped member 86 extending generally longitudinally along the lower surface 22 of the sole plate 18 and interconnected therewith by an elongated interconnecting member 88. The lateral width of the interconnecting member 88 is less than that of the rod-shaped member 86 in order to form the above-mentioned undercut edge configuration 70. Correspondingly, the undercut wall portion 82 of the intermediate interlock receptacle 64 has a configuration that is receivingly complementary to that of the undercut edge portion 68 formed and defined by the rod-shaped member 86 and the interconnecting member 88, thereby providing for the above-discussed removable and interlocking engagement.

In the preferred embodiment of the support structure assembly 16, the mutual mating surfaces 42*a* and 42*b* of the truck members 40*a* and 40*b*, respectively, extend longitudinally generally along the longitudinal centerline 90 of the truck assembly 20. Preferably, the centerline 90 is generally colinear with the longitudinal centerline 92 of the sole plate 18 when the truck members 40*a* and 40*b* are attached to one anothr with the truck assembly 20 removably attached to the sole plate 18. The interlock members 58, 60 and 62 are preferably located on the sole plate 18 such that they are each bisected into two generally equal parts by the longitudinal centerline 92, and the corresponding interlock receptacle 62, 64 and 66 are preferably symmetrically formed along or adjacent to the respective mutual mating surfaces 42*a* and 42*b* of the truck members 40*a* and 40*b*. Therefore, when the truck members 40*a* and 40*b* are moved into their mutual mating engagement, while in contact with the lower surface 22 of the sole plate 18, the interlock receptacle 62, 64 and 66 interlockingly receive and engage the interlock members 56, 68 and 60, respectively, as described above.

The attachment of the truck members 40*a* and 40*b* to one another, can be by way of the exemplary threaded fasteners 50 extending through the apertures 52, for example, and therefore serves to secure the truck assembly 20 to the sole plate 18 because of the above-mentioned interlocking engagement of the interlock members and their corresponding interlock receptacles. Preferably, either the interlock members 56, 58 and 60, or at least the portions of the truck members 40*a* and 40*b* adjacent the interlock receptacles 62, 64 and 66, are composed of a resilient and compliant material in order to assure a relatively tight interlocking engagement between the interlock members and their corresponding interlock receptacles.

Figure 10:
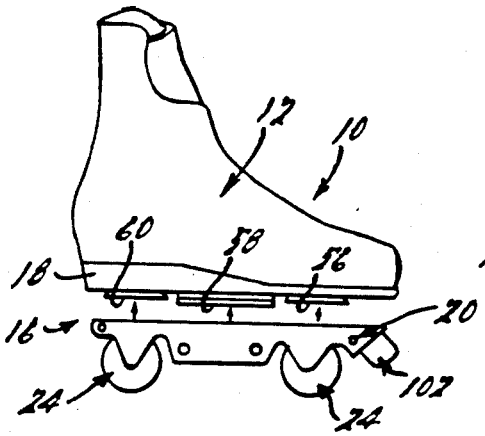
FIG. 10 is a side elevational view of one embodiment of the invention wherein the sole plate is incorporated into the sole portion of a skating boot or other skating footwear.
Figure 11:
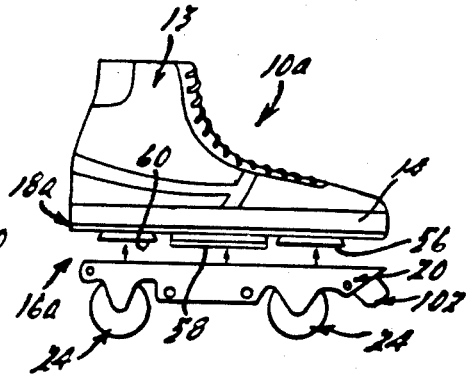
FIG. 11 is a side elevational view of another embodiment of the invention wherein the sole plate is fixedly securable to the sole portion of a variety of footwear items, such as a conventional sport shoe.

As shown in FIG. 10, the sole plate 18 can integrally comprise the sole portion of the boot, shoe or other footwear item 12 of the roller skate 10. Alternatively, as shown in FIG. 11, an alternate sole plate 18*a* can be either fixedly or removably secured to the sole portion 14 of a sport shoe 13 or some other similar footwear item. One skilled in the art will readily recognize that the sole plate 18*a* in FIG. 11 may be attached or secured to the sole portion 14 by an adhesive material, be releasable clamp or clip members, or by other suitable attachment means known in the art. Although the support structure assemblies 16 and 16*a* are shown for purposes of illustration in FIGS. 10 and 11, one skilled in the art will also recognize that the other support structure assemblies shown in the drawings and discussed below can also alternatively be an integral part of a footwear item or can be fixedly or removabely secured thereto.

Figure 23:
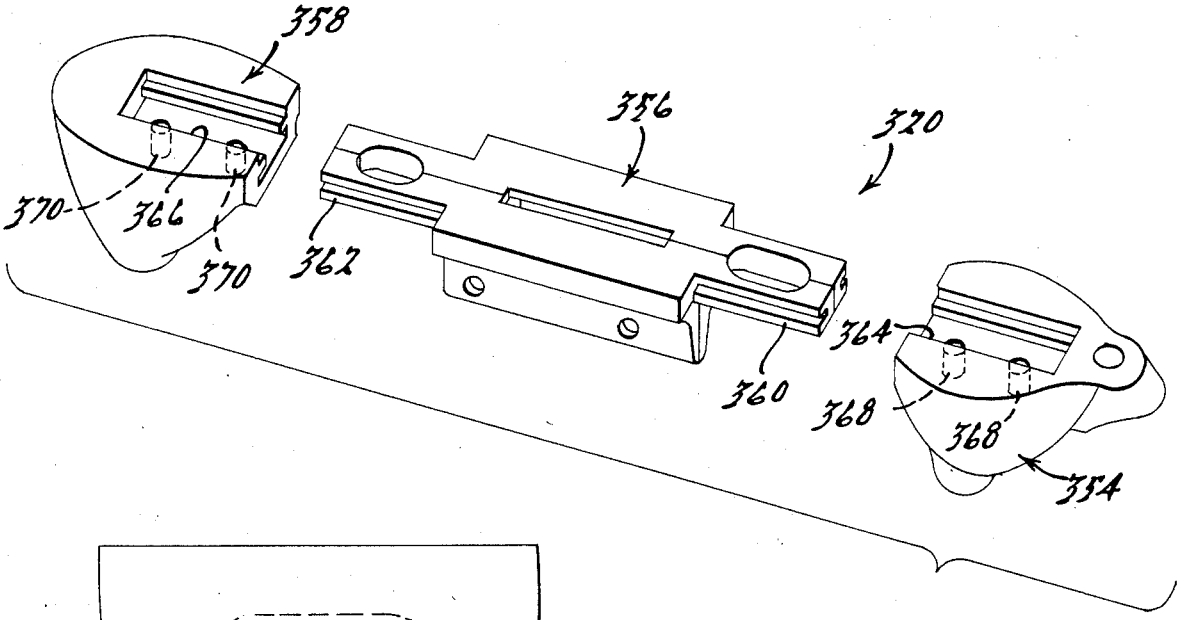
FIG. 23 is an exploded perspective view of another embodiment of the truck member assembly according to the present invention.

As shown in FIG. 23, an alternate optional truck assembly 320 can be provided with a forward portion 354, an intermediate truck member portion 356, and a reaward portion 358. The intermediate portion 356 is split into laterally separable truck members along a longitudinal separation line and includes interlock receptacles, generally similar to those of the truck members 40 discussed above, or releasably securing the truck assembly 320 to a sole plate (not shown) in a manner similar to that described above in connection with the truck assembly 20. The intermediate truck member portion 356 includes forward and rearward tongue portions 360 and 362, respectively, that slidably and adjustably engage corresponding slots 364 and 366 on the forward and reaward portions 354 and 358, respectively. The tongue portions 360 and 362 have a configuration wherein they interlock in a tongue-and-groove sliding engagement with the respective slots 364 and 366. This sliding engagement further allows the overall length of the truck assembly 320, as well as the longitudinal positions of the front and rear axles and wheels, to be selectively altered and adjusted to suit the individual user or to adapt to a particular skating application. Once the longitudinal positions or the forward portion 354 and the rearward portion 358 are preselected or adjusted relative to the intermediate portion 356, they are each releasably locked in place by one or more set screws 368 and 370 engaging the respective tongue portions 360 and 362, or by way of other suitable releasable fastening or retaining means.

Figure 12:
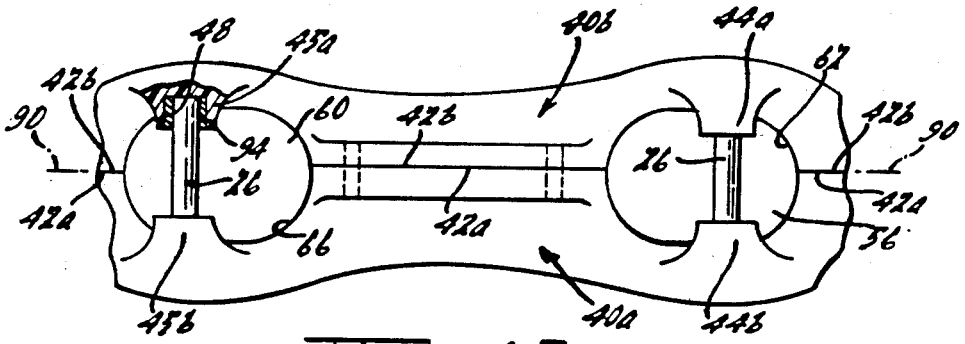
FIG. 12 is a partial bottom view of the truck members of FIG. 8, shown in a mutually mating engagement with one another.
Figure 13:
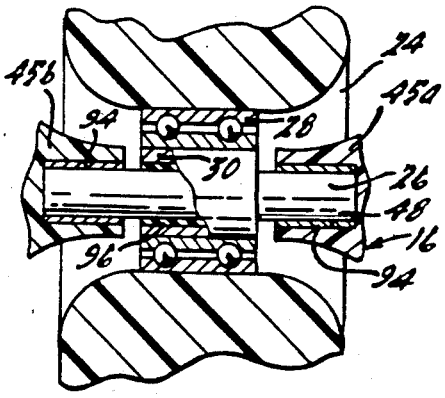
FIG. 13 is a partial cross-sectional view, taken through a wheel and axle assembly, illustrating an alternate embodiment of the axle and bearing assembly of the invention.
Figure 14:
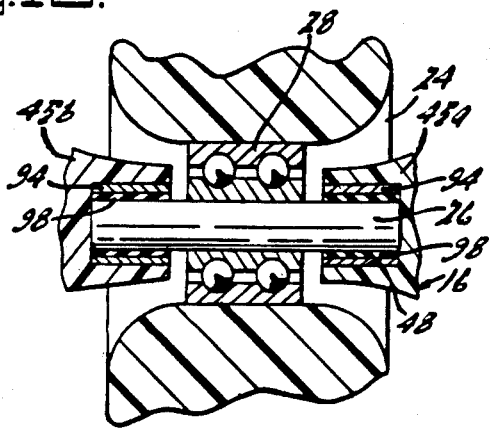
FIG. 14 is a cross-sectional view similar to that of FIG. 13, but illustrating still another alternate axle and wheel bearing embodiment.

Referring primarily to FIGS. 12 through 14, at least one of the sets of the forward axle support portions 44*a* and 44*b*, or the rearward axle support portions 45*a* and 45*b*, can optionally include insert sleeves 94 in their respective axle receiving apertures 48 for receiving and engaging their respective axles 26. Whether or not such insert sleeves 94 are employed, the bearing assemblies 28 can optionally include a resilient bearing sleeve 96 disposed between the bearing assembly 28 (or an inner bearing sleeve portion 30 thereof) and the axle 26. The resilient bearing sleeve 96 resiliently suspends the support structure assembly 16 relative to the wheel members 24 and resiliently allows for movement or shifting of the axis of rotation of the wheel members 24 relative to the axles 26. Such relative movement or shifting can occur during any of a number of roller skating maneuvers, such as cornering, for example.

FIGS. 14, 25 and 26 illustrate alternate configurations for providing resiliency between the wheels 24 and the support structure assembly 16. As shown in FIG. 14, at least one bearing member 28 of a wheel 24 directly engages the corresponding axle 26, and resilient insert sleeves 98 are disposed between the axle 26 and the insert sleeves 94 of the support structure assembly 16 (or directly between the axle 26 and the support structure assembly 16, as shown in FIG. 25). Both the resilient bearing sleeves 96 and the resilient insert sleeves 98, shown alternatively in FIGS. 13, 14 and 25, are preferably comprised of an elastomeric material and have a generally cylindrical configuration with an aperture having at least one open end and extending axially therethrough.

In FIG. 26, still another alternate configuration for providing resiliency is illustrated, wherein an alternate axle support portion 245*a* (or 245) is partially surrounded and reinforced by an outer sleeve 246 and includes a radially elongated opening extending axially through a portion thereof for receiving the axle 26. One or more spring members 249 are received in respective radially-extending apertures 248 and are restrained and compressed preferably by respective retaining screws 250 or other suitable retaining devices. The desired degree of resiliency between the axle 26 and the support assembly 245*a* can be adjustably obtained by tightening or loosening the retaining screws 250. Furthermore, the radial direction of the centerlines of the apertures 248 can be predetermined in order to derive specific desired resiliency characteristics for a given application. By orienting the apertures 248 along lines that are inclined between the horizontal and vertical directions, however, both vertical and horizontal resiliency is obtained.

FIGS. 15 through 18, and 24, illustrate alternate embodiments of the quick-change wheel and axle features of the present invention for use in a support structure assembly 116 having a truck assembly 120 that is not necessarily split into separate truck members. It should be noted that the alternate embodiments shown in FIGS. 15 through 18, and 24, are applicable to roller skates having wheels 124 that are sufficiently narrow to fit between the axle receiving portions 144 on the truck assembly 120. It should be noted that any of the quick-change axle mechanisms or assemblies shown in FIGS. 15 through 18, and 24, can also optionally be employed in conjunction with the support structure assembly 16 and the split truck assembly 20 shown above, as well as the various variations thereon. In such split-truck applications, the wheels 24 need not necessarily be sufficiently narrow to fit between the respective axle receiving portions 144*a* and *b*.

Figure 15:
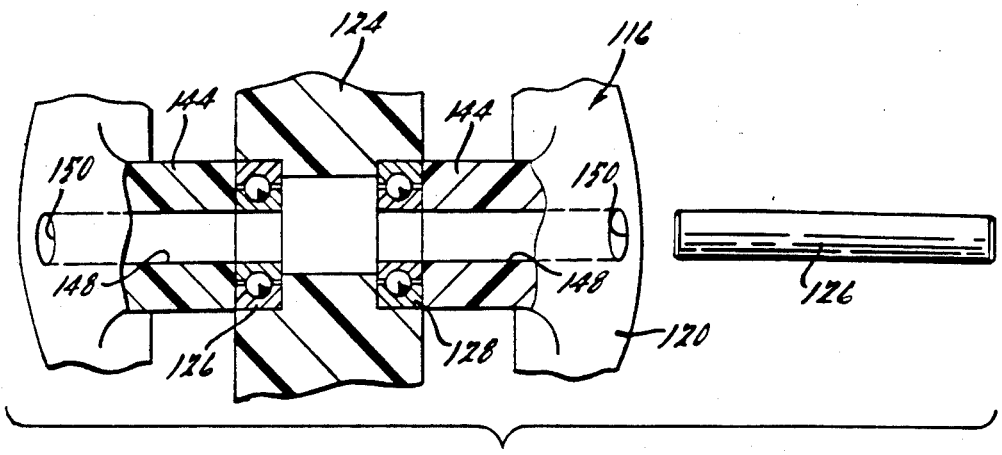
FIG. 15 is a partial cross-sectional view of an alternate quick-change wheel and axle assembly.

In FIG. 15, at least one (and preferably both) of the axle receiving portions 144 on the truck assembly 120 includes an aperture 148 extending therethrough and having an open end 150 thereon. The aperture (or apertures) 148 in the truck assembly 120 are positioned so as to align with the axle receiving openings in the bearing assemblies 128 on the wheels 124. The apertures 148 are adapted to receive an axle 126 inserted through their open ends 150, with the axle 126 being adapted and sized for a substantially press-fit frictional relationship within the apertures 148. Accordingly, in order to quickly and conveniently remove or install the wheels 124 on the truck assembly 120, the axles 126 are forcibly driven out of, or into, their frictional press-fit engagement with the apertures 148 in the axle receiving portions 144.

Figure 16:
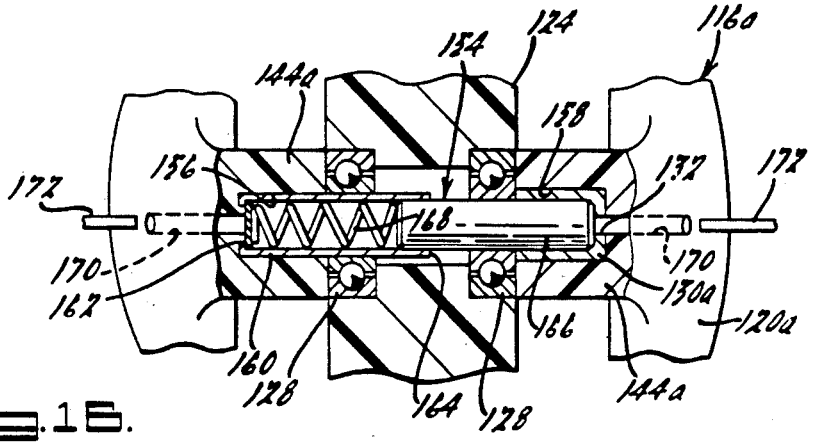
FIG. 16 is a partial cross-sectional view of an alternate quick-change wheel and axle assembly according to the invention.

FIG. 16 illustrates another alternate quick-change axle and wheel assembly having a collapsible axle assembly 154 engageable with apertures 156 and 158 in the axle receiving portions 144*a* of the truck assembly 120*a*. The collapsible axle assembly 154 shown in FIG. 16 preferably includes a generally hollow sleeve member 160 having a closed end 162 and an open end 164 thereon. The sleeve member 160 is adapted to slidably receive at least a portion of a generally cylindrical axle rod member 166 therein with a resilient member, such as the spring member 168, disposed within the sleeve member 160 between the closed end 162 and the axle rod member 166. When the collapsible axle assembly 154 is mounted between the spaced-apart axle receiving portions 144*a*, the spring member 168 resiliently biases the axle rod member 166 and the closed end 162 of the sleeve member 160 away from one another and into engagement with the axle receiving portions 144*a*.

In order to conveniently and quickly remove the wheel 124 from the truck assembly 120*a*, apertures 170 are provided in the axle receiving portions 144*a*. The apertures 170 are adapted to receive a rod or tool member insertable therein for forcibly sliding the axle rod member 166 and the closed end 162 of the sleeve member 160 toward one another against the biasing force of the spring member 168 in order to collapse and shorten the axle assembly 154. When the axle assembly 154 is sufficiently shortened, the wheel 124 and the collapsed axle assembly 154 may be removed from between the axle receiving portions 144*a*. The wheel 124 may then be slidably removed from the axle assembly 154 in order to effect the desired wheel change. In order to reinstall the wheel 124 and the axle assembly 154, the axle assembly 154 is collapsed and shortened sufficiently to allow it to fit between the axle receiving portions 144*a* and then released to be received within the apertures 148. It should be noted that either or both of the apertures 148 in the axle receiving portions 144*a* may also include an insert sleeve 130*a* with an opening 132 in its end for receiving the tool member 172 therethrough.

Figure 17:
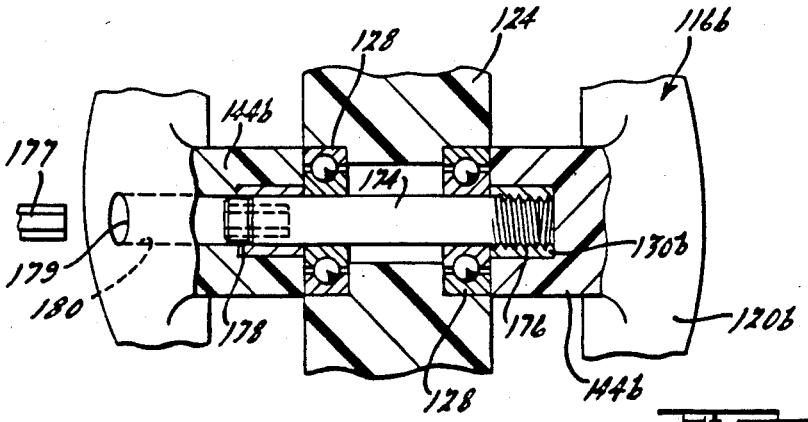
FIG. 17 is a partial cross-sectional view of still another alternate quick-change wheel and axle assembly according to the invention.

FIG. 17 illustrates another alternate quick-change axle apparatus having an axle member 174 with a threaded end portion 176 and a tool-engaging portion 178 thereon. In order to remove or install the axle member 174 between the axle receiving portions 144*b*, a tool member 177 is inserted through an open end 170 of an aperture 180 in one of the axle receiving portions 144*b*. The tool member 177 is used to selectively rotate the axle member 174 into or out of threadable engagement with a threaded insert sleeve 130*b* in the opposite axle receiving portion 144*b*. Once the axle member 174 is rotated and threadably released so as to be removed from the truck assembly 120*b*, the wheel 124 is free to be removed from between the axle receiving portions 144*b*. When the wheel 124 is to be installed on the truck assembly 120*b*, the above procedure is reversed, and the tool member 172 is used to rotate the axle member 174 into threadable engagement with the insert sleeve member 130*b*, thereby securing the axle member 174 and the wheel 124 to the truck assembly 120*b*.

Figure 18:
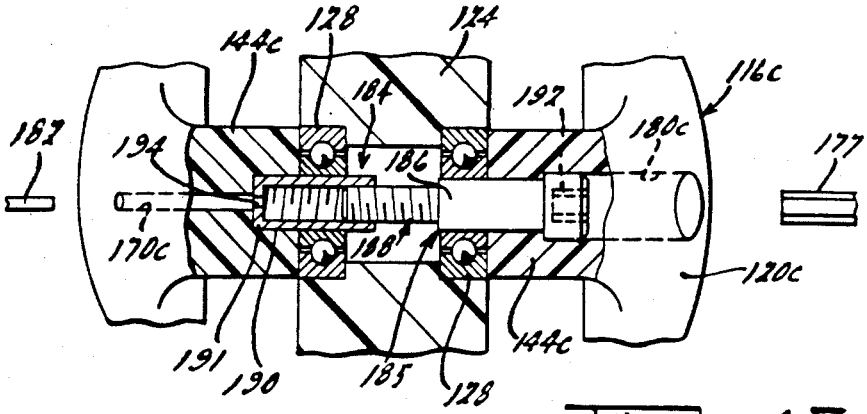
FIG. 18 is a partial cross-sectional view of still another quick-change wheel and axle assembly according to the invention.

FIG. 18 illustrates still another alternate embodiment of a quick-change wheel and axle arrangement according to the present invention. A collapsible axle assembly 184 shown in FIG. 18 includes a generally cylindrical axle rod member 185 having a shank portion 186 and a threaded portion 188 thereon. The threaded portion 188 is adapted to threadably engage an internally-threaded cylindrical sleeve member 190 such that the axle rod member 185 and the sleeve member 190 may be selectively rotated relative to one another and threadably urge the rod member 185 toward or away from the closed end 191 of the sleeve member 190, thereby selectively increasing or decreasing the overall length of the collapsible axle assembly 184. Such relative rotation is accomplished by inserting a tool member 177 through an aperture 180*c* in one of the axle receiving portions 144*c* and engaging a tool-engaging portion 192 of the axle rod member 185. Simultaneously, another tool member 182 is inserted through an aperture 170*c* in the other of the axle receiving portions 144 and is placed in engagement with a tool engaging portion 194 on the closed end 191 of the sleeve member 190.

Similar to the resilient collapsible axle assembly 154 shown in FIG. 16, the overall length of the collapsible axle assembly 184 in FIG. 18 may be shortened sufficiently to allow the axle assembly 184 and the wheel 124 to be removed from between the axle receiving portions 144*c*. In order to reinstall the wheel 124 and the axle assembly 184, the above procedure is reversed. The axle rod member 185 and the sleeve member 190 are rotated in a direction to threadably urge the rod member 185 away from the closed end 191 of the sleeve member 190, thereby lengthening the axle assembly 184 and urging into engagement with the axle receiving portions 144.

Figure 24:
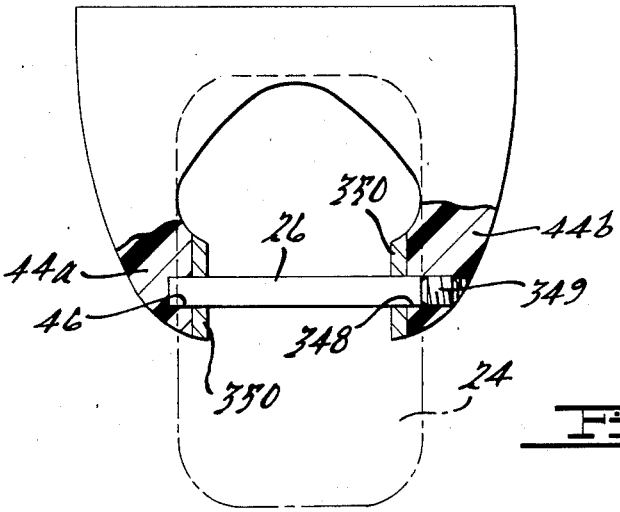
FIG. 24 is a rear elevational view illustrating still another embodiment of the truck member assembly, axles and wheels according to the present invention.

FIG. 24 illustrates another alternate quick-change wheel and axle arrangement, wherein one of the axle receiving portions 44*a* or 44*b* has and axial opening 348 therethrough for receiving a retaining screw (or other retaining device) 349 therein. The retaining screw 349 may be removed to in turn allow the axle 26 to be removed through the opening 348. In order to prevent or retard undesirable wear or enlargement of the apertures 46 or 348, the axle receiving portions 44*a* and 44*b* can optionally be equipped with end plates 350.

FIG. 27 illustrates an optional ice skate runner attachment 380, which can be attached to the truck assembly 20 in lieu of the wheels 24 in order to convert the roller skate 10 (FIG. 1) to an ice skate. The ice skate runner attachment 380 is secured to the truck assembly 20 by the axles 26 extending through apertures 382 and being received and restrained in the apertures 48 of the axle receiving portions 44*b* and 45*b* of the truck member 40*b*, and similarly in the apertures 46 of the axle receiving portions 44*a* and 44*b* of the truck member 40*a* (not shown). Thus, as is described above, when the truck assembly 20 is secured to the sole plate 14 (FIG. 2), the axles 26 and the ice skate runner attachment is secured and restrained between the truck members 40*a* and 40*b*, and the roller skate 10 (FIG. 1) is selectively converted to an ice skate.

It should be noted that although many of the embodiments of the invention described herein and shown in the drawings illustrate one or the other of the axle receiving portions, or one or the other of the truck members, such alternate embodiments are generally applicable to any or all of such axle receiving portions or truck members.

It should further be noted that any of the above-discussed embodiments of the roller skate apparatus according to the present invention can also optionally include a toe stop device on its forward end. Such toe stop devices are frequently desirable for allowing the wearer of the roller skate to merely tip the skate forward such that the toe stop member frictionally engages the ground or floor upon which the wearer is skating and acts as a brake for slowing or halting his or her progress.

Figure 2:
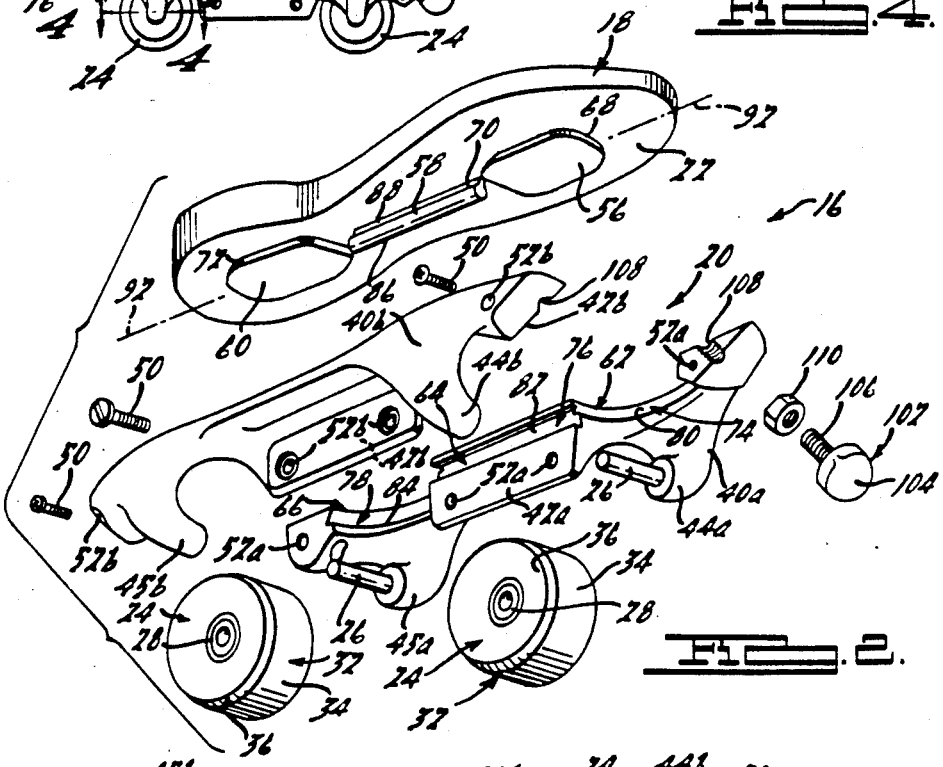
FIG. 2 is an exploded perspective view of one preferred embodiment of the support structure assembly, axles and wheels, according to the present invention, for the roller skate of FIG. 1.
Figure 3:
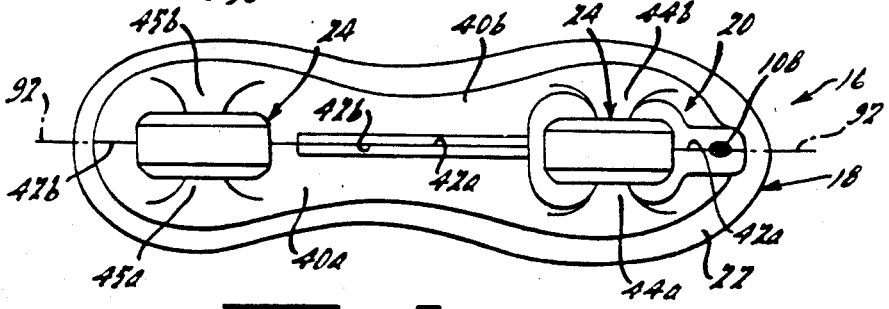
FIG. 3 is a bottom view of the roller skate assembly of FIG. 1, incorporating the support structure assembly and wheels of FIG. 2.
Figure 5:
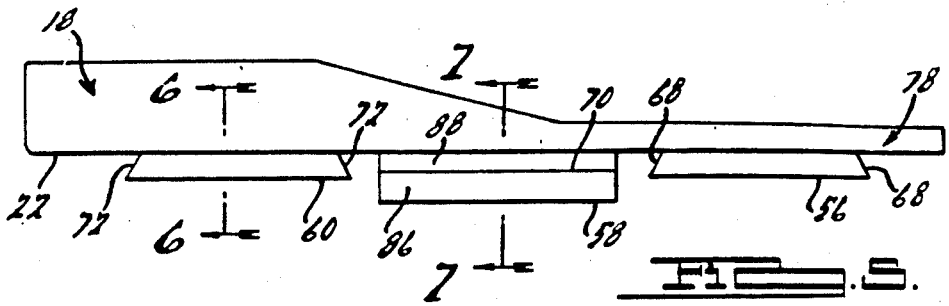
FIG. 5 is a side elevational view of the sole plate portion of the support structure assembly of FIG. 2.
Figure 6:
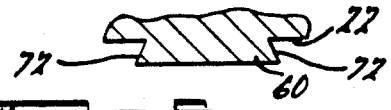
FIG. 6 is a partial cross-sectional view taken generally along line 6—6 of FIG. 5.
Figure 7:
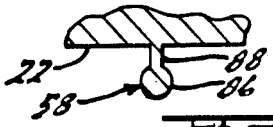
FIG. 7 is a partial cross-sectional view taken generally along line 7—7 of FIG. 5.
Figure 8:
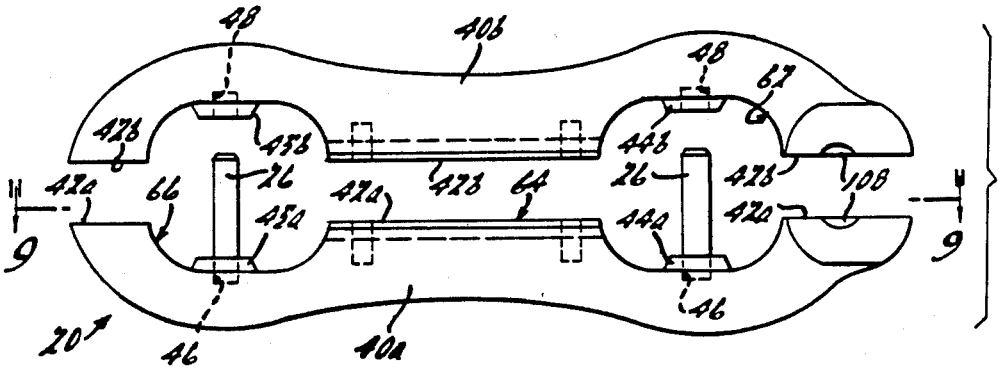
FIG. 8 is a top view of the truck members of the support structure assembly of FIG. 2 in their detached condition.
Figure 9:
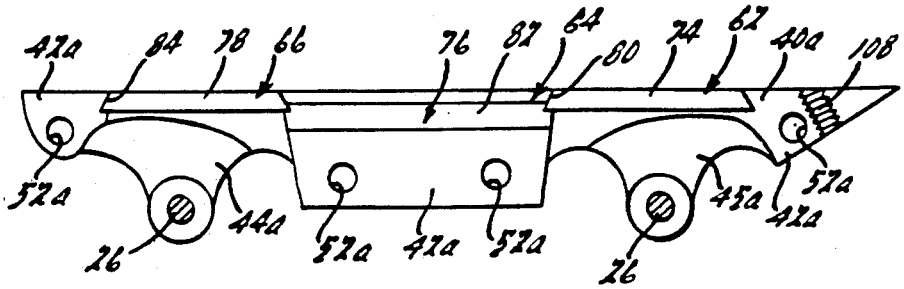
FIG. 9 is a side elevational view of one of the truck members of the support structure assembly of FIG. 2, looking generally in the direction of arrows 9—9 of FIG. 8.

In FIG. 2, one embodiment of a toe stop apparatus 102 includes a frictional element 104 and a threaded rod member 106 adapted to threadably engage a threaded aperture 108 in the truck assembly 20. By rotating the toe stop apparatus 102 the position of the friction element 104 relative to the truck assembly 20 may be adjusted to provide the desired clearance between the friction element 104 and the ground or floor upon which the user is skating. Once the desired relative position between the friction element 104 and the truck assembly 20 is achieved, a jam nut 110 may be threadably tightened into engagement with the truck assembly 20, thereby substantially preventing the toe stop apparatus 102 from undesired rotation.

Figure 19:
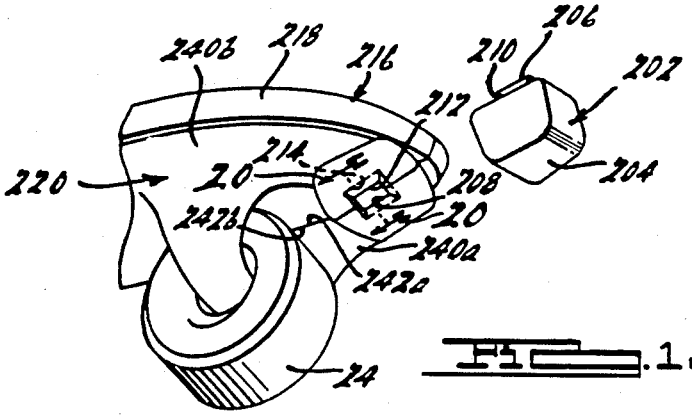
FIG. 19 is a partial exploded perspective view of a support structure assembly, illustrating a stop member adapted to be removably attached thereto.

FIG. 19 illusutrates an alternate toe stop apparatus 202 including a friction element 204 with an integral interlock member 206 thereon. In the embodiment illustrated in FIG. 19, the truck assembly 220 includes an interlock receptacle 208 located on a forward portion thereof and adapted for interlockingly and removably receiving the interlock member 206 therein. Like the interlock members 56 and 58 and the interlock receptacles 62 and 66 described above, the interlock member 206 includes a beveled undercut edge portion 210 which is interlockingly and removably engageable with an undercut peripheral wall portion 214 of a peripheral wall 212 that at least in part defines the interlock receptacle 208. The interlock receptacle 208 is preferably located on the truck assembly 220 so that it is bisected into two generally equal parts when the truck members 240*a* and 240*b* are separated along their respective mutually mating surfaces 242*a* and 242*b*. Thus, when the truck members 240*a* and 240*b* are attached to one another with the interlock member 206 interlockingly received by the interlock receptacle 208, the top stop apparatus 202 is securely attached to the truck assembly 220. Preferably, either or both of the interlock member 206 or the portion of the truck members surrounding the interlock receptacle 208 are composed of a resilient compliant material in order to assure a relatively tight interlocking engagement therebetween.

Figure 20:
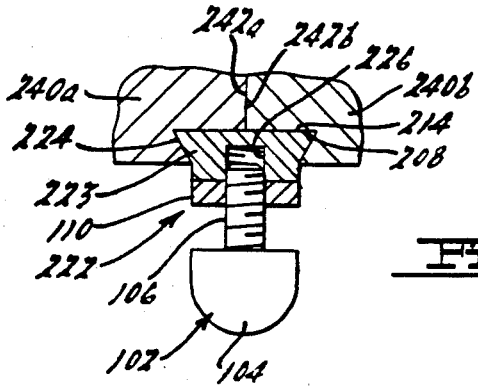
FIG. 20 is a partial cross-sectional view taken generally along line 20—20 of FIG. 19, but illustrating an adjustable stop member embodiment removably attachable to the support structure assembly.

FIG. 20 illustrates still another alternate toe stop apparatus 222 having a separate interlock member 223 with an undercut edge portion 224 thereon, that is generally similar to the interlock member 206 and the undercut portion 210 shown in FIG. 19 and described above. The interlock member 222 and the undercut edge portion 224 are adapted to be interlockingly and removably received within the above-described interlock receptacle 208 in the truck assembly 220. Instead of having an integral friction element, however, the interlock member 223 of the toe stop apparatus 222 includes a threaded aperture 226 therein for threadably receiving the threaded rod member 106 of the toe stop apparatus 102 shown in FIG. 2 and discussed above. Thus, either before or after the separate interlock member 223 is interlockingly attached to the truck assembly 220, the toe stop apparatus 102 may be threadably rotated as described above in order to adjust the relative position between the friction element 104 and the interlock member 223. As described above, when the desired relative position is obtained, the jam nut 110 is threadably tightened into engagement with the interlock member 223 in order to substantially fix the position of the friction element 204 relative to the truck assembly 220. It should be noted that the toe stop arrangements shown in FIGS. 2, 19 and 20 may be employed in conjunction with any of the embodiments of the invention shown and described herein. It should also be noted that such toe stop arrangements are equally applicable and adaptable to stop members located at other than toe or forward locations on the roller skate.

Figure 28:
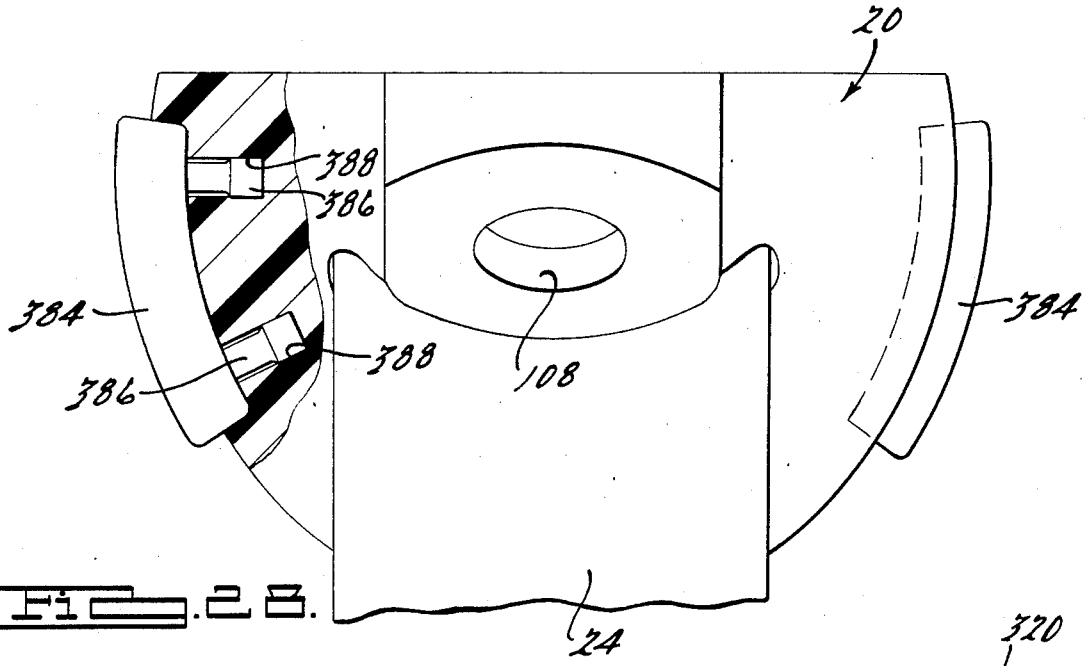
FIG. 28 is a front elevational view, illustrating still another embodiment of a truck member assembly, according to the present invention, having replaceable bumper members on its lateral sides.

FIG. 28 is a front elevational view of the truck assembly 20, with optional side bumper members 384 attached thereto. The side bumper members 382, which are preferably composed of a resilient material, prevent or at least minimize the scuffing of the lateral sides of the truck assembly 20 or other portions of the roller skate 10 (FIG. 1). The replaceable bumper members 384 which may also be mounted at other locations on the truck assembly, forward, rearward or intermediate, preferably have integral pins protruding therefrom that are frictionally inserted into corresponding apertures 388 in the truck assembly 20. Alternatively, the bumper members 384 can be releasably attached to the truck assembly by other suitable retention means known to those skilled in the art.

Figure 29:
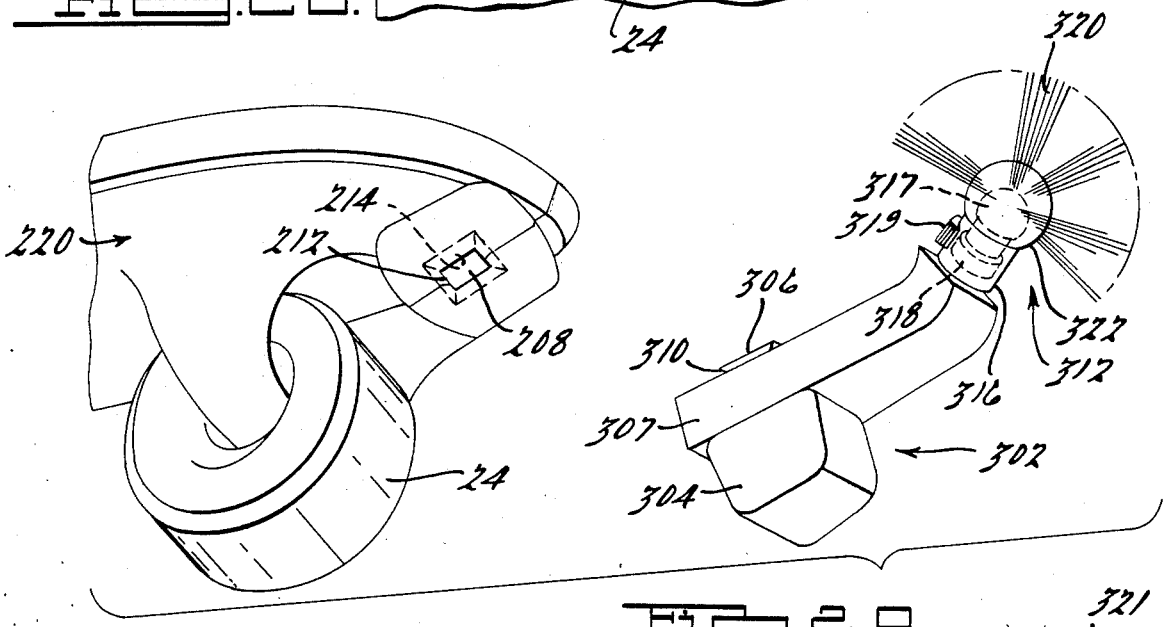
FIG. 29 illustrates a toe stop assembly similar to that of FIG. 19, but having an optional decorative illumination device thereon.
Figure 30:
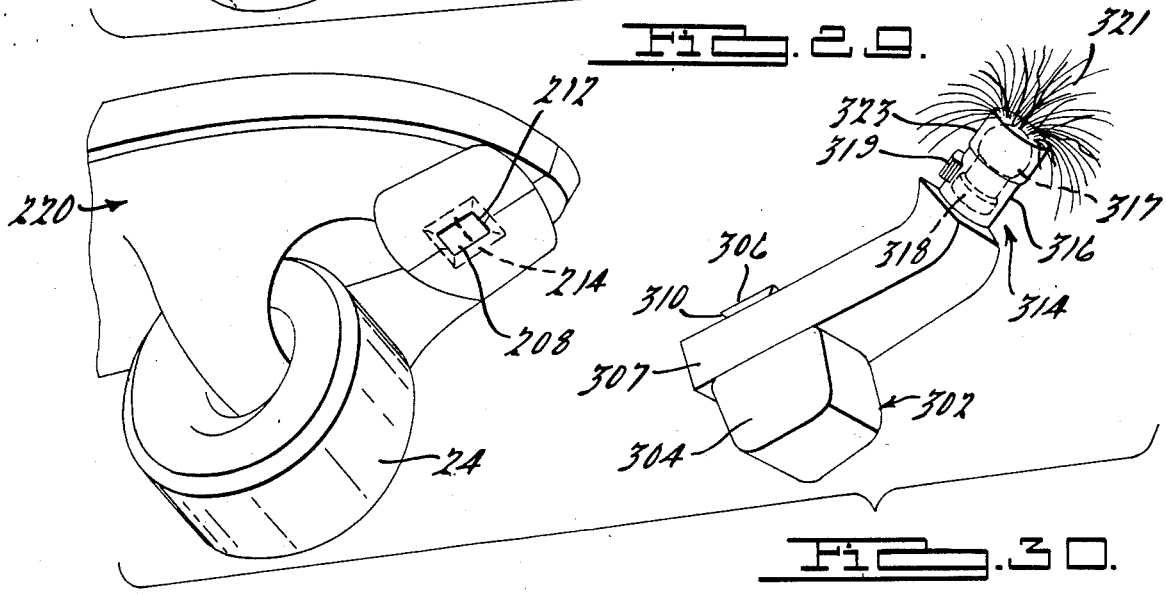
FIG. 30 is a view similar to that of FIG. 29, but illustrating an alternate optional decorative illumination device thereon.

FIGS. 29 and 30 illustrate an optional alternate toe stop appartus 302, similar to that of FIG. 19, but with decorative illumination devices 312 and 314, respectively, thereon. Like the toe stop apparatus 202 of FIG. 19, the toe stop apparatus 302 of FIGS. 29 and 30 includes a friction element 304 and an interlock member 306, with an undercut edge portion 310, but the interlock member 306 is on a base 307. Thus the toe stop apparatus 302 can be releasably mounted onto the truck assembly 220 in a manner similar to that described above in connection with FIG. 19.

The toe stop apparatuses 302 in FIGS. 29 and 30 include illumination devices 312 and 314, respectively. Illumination devices 312 and 314 are secured to the base 307 and each preferably include a housing 316, and electric light source 317, an electrical power source 318, and an on-off switch 319. An exemplary illumination material 320 includes a series of generally straight optic fibers of generally uniform length protruding from a transparent or translucent bowl 322 in a substantial length such that their outer ends are illuminated when the light source 317 is energized and illuminated. Alternatively, illumination material 321 can include random, optic fiber shapes cut to non-uniform lengths and arranged to protrude in a random pattern on a transparent or translucent portion 323 of the housing 316 in FIG. 30. In either case, the outer ends of the optical fibers in the illumination devices 320 and 321 will be illuminated whenever the light source 317 is illuminated, thereby adding an interesting and decorative effect to the roller skate 10 (FIG. 1) when used in darkened or semi-darkened environments. One skilled in the art will readily recognize that alternate forms of illumination materials may be illuminated by the light source 317 other than the exemplary materials shown and described herein.

It should be noted that either of the illumination devices of FIGS. 29 and 30 can alternatively be attached to portions of the roller skate 10 other than the truck assembly.

The foregoing discussion discloses and describes exemplary embodiments of the present invention. One skilled in the art will readily recognize from such discussion that various changes, modifications and variations may be made therein without departing from the spirit and scope of the invention as defined in the following claims.

We claim:

1. A roller skate comprising a support structure, two wheel members including bearing means thereon, and means for mounting said wheel members on said support structure for rotation about separate axes, each of said wheels comprises an internal reinforcing member and a moldable material, said reinforcing member being integrally molded within said moldable material, said internal reinforcing member comprises an annular disc, said disc having an axially-extending axle-receiving opening therethrough, said disc extending radially outwardly from said opening and having a pair of opposite axially-facing sides, said protruding means comprises a number of protuberances circumferentially spaced on at least one of said axially-facing sides and protruding in a generally axial direction therefrom, said wheel members being of a generally toroidal configuration and having a ground-engaging peripheral surface extending circumferentially therearound, said ground-engaging peripheral surface of each wheel member having a central portion that is generally flat in diametric cross-section and that extends axially in a direction generally parallel to the wheel member's respective axis, said ground-engaging peripheral surface of each wheel member further having at least one arcuate portion disposed axially adjacent said central portion and curving generally radially inwardly therefrom.

2. A roller skate according to claim 1, wherein each of said opposite sides of said disc has a number of said protuberances thereon.

3. A roller skate according to claim 1, wherein each of said wheel members further comprises a generally cylindrical bushing member on each axial side of said reinforcing member for receiving an axle extending through said wheel member, said bushing members also being integrally molded with said moldable material.

4. A roller skate according to claim 1, wherein said central portion has an axial width of at least 50% of the total axial width of its respective wheel member.

5. A roller skate according to claim 1, wherein said ground-engaging surface of each wheel member includes one of said arcuate portions disposed on each axial side of said central portion.

6. A roller skate according to claim 5, wherein said central portion has an axial width of at least 50% of the total axial width of its respective wheel member.

7. A roller skate comprising a support structure, two wheel members including bearing means thereon, and means for mounting said wheel members on said support structure for rotation about separate axes, each of said wheel members comprises an internal reinforcing member and a moldable material, said reinforcing member being integrally molded within said moldable material, said internal reinforcing member comprises an annular disc, said disc having an axially-extending axle-receiving opening therethrough, said disc extending radially outwardly from said opening and having a pair of opposite axially-facing sides, a number of protuberances circumferentially spaced on each of said axially-facing sides and protruding in a generally axial direction therefrom, said wheel members being of a generally toroidal configuration and having a ground-engaging peripheral surface extending circumferentially therearound, said ground-engaging peripheral surface of each wheel member having a central portion that is generally flat in diametric cross-section and that extends axially in a direction generally parallel to the wheel member's respective axis, said ground-engaging peripheral surface of each wheel member further having at least one arcuate portion disposed axially adjacent said central portion and curving generally radially inwardly therefrom.

* * * * *

UNITED STATES PATENT AND TRADEMARK OFFICE

CERTIFICATE OF CORRECTION

PATENT NO. : 4,666,169

DATED : May 19, 1987

INVENTOR(S) : Steve Hamill et al

It is certified that error appears in the above-identified patent and that said Letters Patent is hereby corrected as shown below:

Column 1, line 5, "599,996" should be -- 599,966 --.
Column 5, line 19, "rotatably" should be -- rotatable --.
Column 5, line 59, "member" should be -- members --.
Column 6, line 27, "anothr" should read -- another --.
Column 6, line 40, "68" should be -- 58 --.
Column 6, line 64, "be" should be -- by --.
Column 7, line 8, "reaward" should be -- rearward --.
Column 7, line 28, "or" should read -- of --.
Column 9, line 30, "170" should be -- 179 --.
Column 10, line 13, "and" should be -- an --.
Column 11, line 21, "top" should be -- toe --.
Column 11, line 61, "382" should be -- 384 --.

Signed and Sealed this

Twenty-sixth Day of April, 1988

*Attest:*

DONALD J. QUIGG

*Attesting Officer*

*Commissioner of Patents and Trademarks*